United States Patent [19]

Tosswill

[11] Patent Number: 4,714,861

[45] Date of Patent: Dec. 22, 1987

[54] HIGHER FREQUENCY MICROCHANNEL PLATE

[75] Inventor: Christopher H. Tosswill, Sturbridge, Mass.

[73] Assignee: Galileo Electro-Optics Corp., Sturbridge, Mass.

[21] Appl. No.: 913,955

[22] Filed: Oct. 1, 1986

[51] Int. Cl.[4] ..... H01J 7/24; H01J 43/00

[52] U.S. Cl. ..... 315/117; 313/103 CM; 313/105 CM

[58] Field of Search ..... 315/117; 313/103 CM, 313/105 CM

[56] References Cited

U.S. PATENT DOCUMENTS

| | | | |
|---|---|---|---|
| 3,374,380 | 3/1968 | Goodrich | 313/105 CM |
| 3,879,626 | 4/1975 | Washington et al. | 303/105 CM |
| 3,976,905 | 8/1976 | Seidman et al. | 303/103 CM |
| 4,529,912 | 7/1985 | Northrup et al. | 315/117 |
| 4,533,853 | 8/1985 | Hammond et al. | 315/117 |

*Primary Examiner*—H. Dixon

[57] ABSTRACT

A microchannel plate with a plurality of microchannel portions, a portion in an amplifying direction from another portion having a lower surface zone resistance than the other, materials and circuitry being provided to permit controlled higher-temperature operation.

11 Claims, 6 Drawing Figures

HIGHER FREQUENCY MICROCHANNEL PLATE

FIELD OF THE INVENTION

This invention relates to microchannel plates ("MCP"'s), and more particularly to such devices capable of improved frequency of function.

BACKGROUND OF THE INVENTION

MCP's have now been long known in the art; early patents were Goodrich et al. U.S. Pat. No. 3,128,408, "Electron Multiplier", granted Apr. 7, 1964 and Goodrich et al. U.S. Pat. No. 3,341,730, "Electron Multiplier with Multiplying Path Wall Means Having a Reduced Reducible Metal Compound Constituent", granted Sept. 12, 1967.

An early patent disclosing chevron-paired MCP's was Goodrich U.S. Pat. No. 3,374,380, "Apparatus for the Suppression of Ion Feedback in Electron Multipliers", granted Mar. 19, 1968.

In typical prior art MCP's, recovery time (owing to slowness of movement of electrons in channel walls to replenish electrons previously emitted from the walls) has been in general several milliseconds. This has limited the frequency (herein, in proper context, "frequency") of use of the device to about the order of 200 Hz.

A single section (total of two electrodes) MCP with lower resistance in amplified-end channel surface zone material has been suggested in the prior art.

SUMMARY OF THE INVENTION

I have discovered that recovery time may be considerably shortened in MCP's—indeed, to frequencies greater than 100 kHz.

In one aspect of my invention, I provide an MCP with a plurality of sections, wall surface zone resistance being less in any such zone in an electron amplification direction from another such zone, and each section being provided with electrodes.

In another aspect of my invention, circuitry is provided which prevents thermal runaway and makes possible controlled higher temperature of operation.

In preferred embodiments there are two sections, in contact, chevron-related, and with a common electrode between them; each section is driven by a constant current power supply, resistances in the sections being controlled by cooling means in turn controlled through a voltage comparator; and the sections are fabricated from high-temperature glass.

PREFERRED EMBODIMENT

The structure and operation of a preferred embodiment is as follows.

DRAWINGS

STRUCTURE

Figure 1:
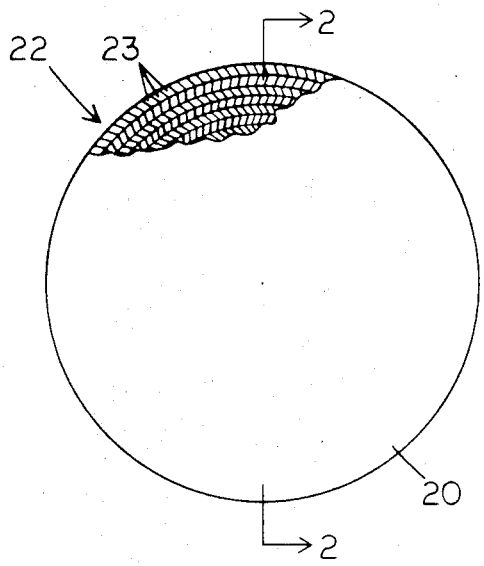
FIG. 1 is a side elevation of the preferred embodiment.
Figure 2:
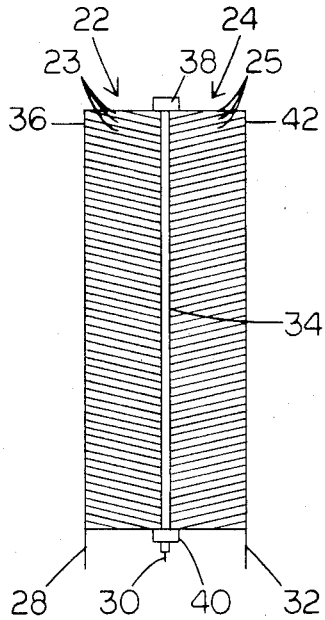
FIG. 2 is a sectional view, taken at 2—2 of FIG. 1, and somewhat diagrammatic.
Figure 3:
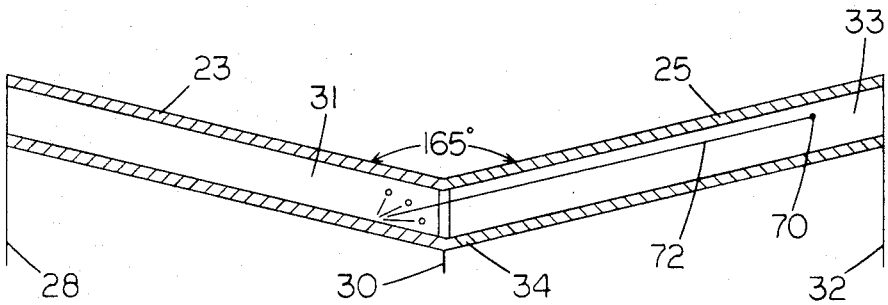
FIG. 3 is a corresponding sectional view through one of the channel members of each section of the MCP of FIG. 2.

In FIGS. 1 and 2 is seen a two-section MCP 20 (detail only shown in upper left-hand corner) with an input array 22 and an output array 24, each including a multiplicity of channel portions 23, 25 with identical channel inside diameters and channel center-to-center spacings. The inside diameter of channels 31, 33 in channel members 23, 25 of arrays 22, 24 is 25 microns.

The glass from which arrays 22, 24 are formed has the following formulation:

| | % by Weight |
|---|---|
| $SiO_2$ | 34.8 |
| $Al_2O_3$ | 0.2 |
| $Rb_2O$ | 3.5 |
| $Cs_2O$ | 2.4 |
| PbO | 54.9 |
| BaO | 4.0 |
| $As_2O_5$ | 0.2 |

This glass is capable of continuous operation at 125° C. Different resistivities are achieved by different processing, in manners well known in the art, of this same glass.

Energy is provided through circuitry hereinafter described and including lines 28, 30, and 32 to provide increasing potential across array 22 and array 24. Array 22 has conductive coatings 36 and 38 on the input and output surfaces respectively, and array 24 has such coatings 40, 42 respectively. Preferably the facing coatings 38 and 40 are provided by ion implantation of nichrome, and are spaced apart by a thin layer of glass 34 deposited by transverse flow so as not to block channel passages 31, 33 in channel members 23, 25, which layer 34 secures together arrays 22, 24. Bonding is by techniques as in Pomerantz U.S. Pat. No. 3,397,278, Aug. 13 1968, "Anodic Bonding", and Pomerantz U.S. Pat. No. 3,417,459, Dec. 24, 1968, "Bonding Electrically Conductive Metals to Insulators".

A ring of nichrome is placed around glass layer 34 to short between layers 38 and 40 so that those layers form in effect a common electrode 84. Layers 36 and 42 provide electrodes 86 and 88 respectively.

Although shown diagrammatically as of equal thickness (in, i.e., an electron flow direction) with array 22, array 24 is in fact much thinner, and is assembled to array 22 and then ground down to final desired thickness. In this preferred embodiment, array 22 has a thickness of 1000 microns, and array 24 a thickness of 200 microns.

Figure 4:
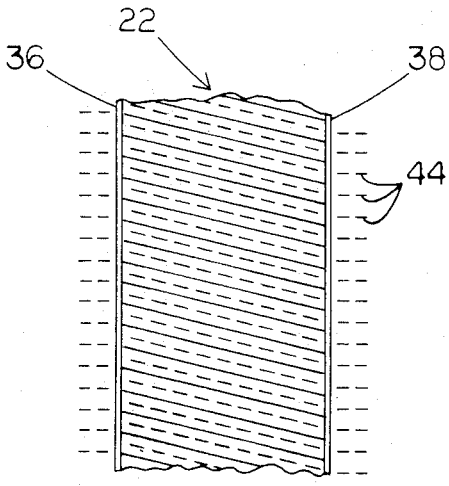
FIG. 4 is an enlarged view of a section, showing field.

The electric field existing in an array is shown in FIG. 4 where field lines 44 are shown parallel to the walls of the channel in the array but bend upon leaving the array channels to assume a direction that is substantially perpendicular to the unipotential surfaces 36 and 38 in the case of array 22.

Figure 6:
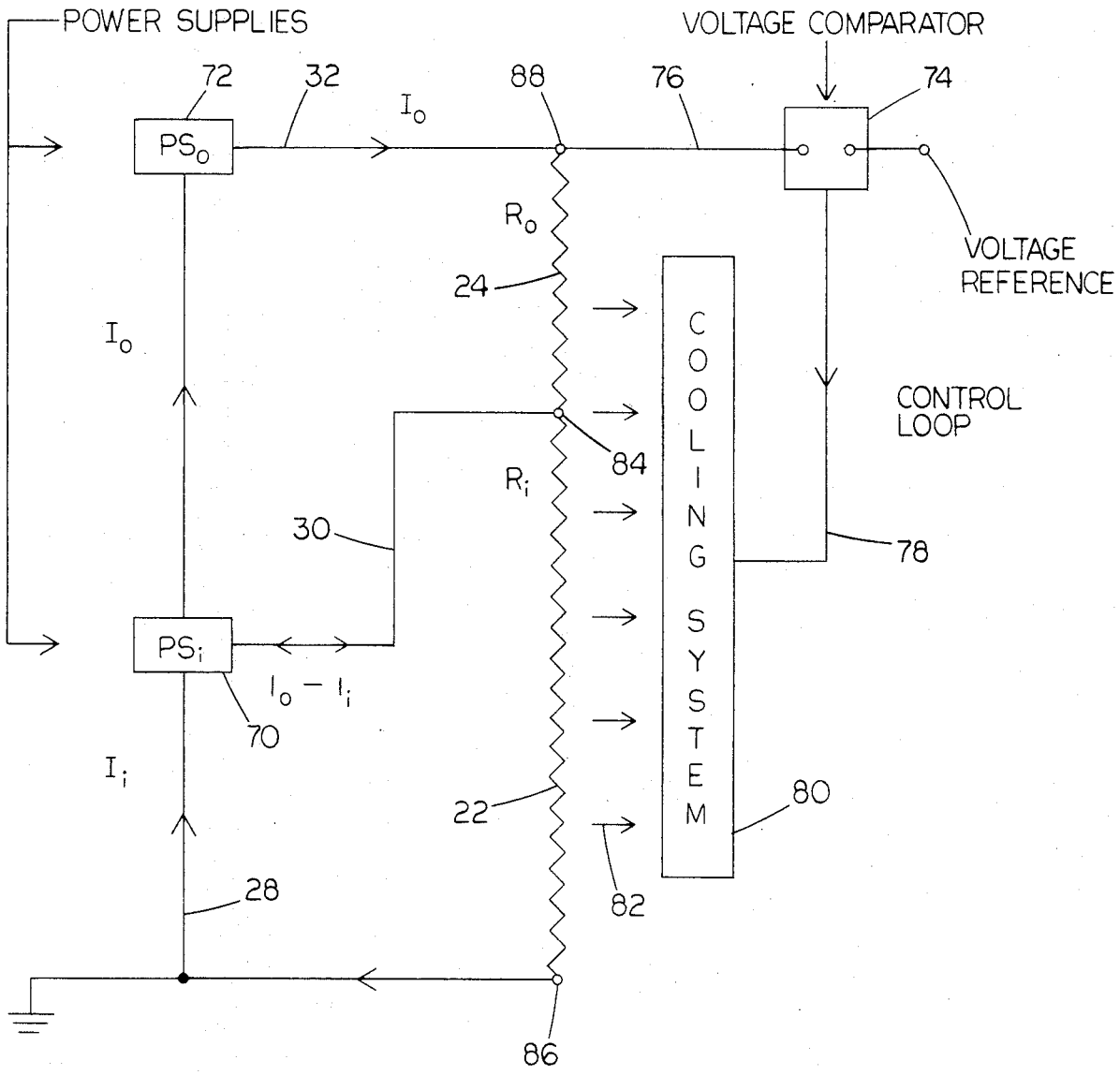
FIG. 6 is a schematic of the control system.

The control circuitry is shown in FIG. 6. $R_i$ and $R_o$ refer to the resistances of the sections or arrays 22 and 24. A power supply 70 supplies a constant current (not voltage) $I_i$ of 50 microamperes per square centimeter (of array 22 cross-sectional—i.e., in a direction perpendicular to net electron flow directions—area), while a power supply 72 supplies a constant current $I_o$ of 250 ) microamperes per square centimeter (of array 24 cross-sectional area), across the two arrays or sections respectively. Voltage comparator 74 through line 76 monitors the voltage there, and through control loop 78 varies the amount of cooling done by thermoelectric cooling system 80, which operates to cool both arrays 22, 24; arrows 82 indicate heat leaving the arrays. The set point voltage in comparator 74 is chosen so that the voltage drops across the arrays 22 and 24 are respectively 1000 volts and 200 volts. (Resistances in the two arrays are respectively 20 megohms per square centimeter and 0.8 megohms per square centimeter.)

Figure 5:
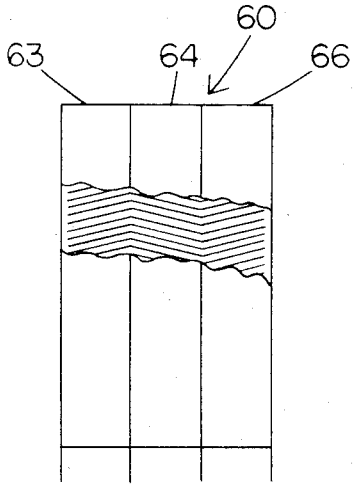
FIG. 5 is a modified embodiment wtih three sections.

There is shown in FIG. 5 a modification embodying three sections or arrays 62, 64, and 66 and two lines from common electrodes.

OPERATION

Because the conductivity in array 24 is five times as great as that in array 22, current is five times as great. Since thickness of array 24 is only one-fifth that of array 22, heat dissipation is the same in both arrays. Heat dissipation through the entire MCP is thus a fraction of what it would be if both section 22 and section 24 had the lower resistance of section 24.

Because increasing quantities of electrons are removed from channel walls the farther along the channel one goes in an amplifying direction, so is wall electron depletion increasingly severe in that direction. (In fact, in this preferred embodiment array thicknesses are chosen such that the total number of electrons lost by each channel wall, net, is the same in each channel 31, 33.)

Accordingly, resistance may be larger in the array 22 without unduly affecting recovery time, inflow-of-electron requirements for recovery in that array being less demanding.

Using constant current power supplies in conjunction with output current of both arrays leads to thermal stability, for rising MCP temperature causes thermal dissipation to fall (because of wall zone resistivity negative temperature coefficient) and radiation losses to rise until a balance is reached.

Use of the two-array approach thus described makes possible a five-fold frequency increase, for wider MCP applicability.

The provision of a glass that can operate at my higher temperature and of a control circuit to prevent runaway permits a further frequency increase of 100 times, so that I have provided the art with a useful operation frequency about 500 times as great as the prior art.

OTHER EMBODIMENTS

Instead of a center electrode between the arrays, a separate electrode could be used at the adjacent ends of the two (or more) arrays; or, they could be spaced apart; both as in the chevron patent above mentioned. The channels of the arrays might have channel axes parallel rather than at an obtuse angle to each other.

Other embodiments within the invention will occur to those skilled in the art.

What is claimed is:

1. A microchannel plate comprising a plurality of arrays, a first array in an electron-amplifying direction from a second array having a surface zone resistance lower than that of said first array.

2. The microchannel plate of claim 1 in which said first array is thicker than said second array.

3. The microchannel plate of claim 2 in which the product of conductivity and thickness is the same for said first array and said second array.

4. The microchannel plate of claim 1 in which said first array abuts said second array.

5. The microchannel plate of claim 4 in which said first array and said second array share a common electrode.

6. The microchannel plate of claim 1 in which said arrays are formed of glass permitting continuous operation at temperatures in excess of 100° C.

7. The microchannel plate of claim 6 in which said arrays are formed of the glass set forth in the description of the preferred embodiment herein.

8. In combination, a microchannel plate, a constant-current power supply for imposing voltage to cause current flow in said microchannel plate, cooling means for said microchannel plate, and control means to regulate said cooling means to maintain operation of said microchannel plate at a predetermined temperature.

9. The combination of claim 8 in which said control means is a voltage comparator.

10. The combination of claim 9 in which said cooling means is thermoelectric.

11. The combination of claim 10 in which the microchannel plate is that of claim 1.

* * * * *